US007251850B1

(12) United States Patent
Elliott

(10) Patent No.: US 7,251,850 B1
(45) Date of Patent: Aug. 7, 2007

(54) BOOT SCRUBBER

(76) Inventor: Glendon M Elliott, 211 Columbus Ave., Pawtucket, RI (US) 02861

( * ) Notice: Subject to any disclaimer, the term of this patent is extended or adjusted under 35 U.S.C. 154(b) by 5 days.

(21) Appl. No.: 11/363,468

(22) Filed: Feb. 28, 2006

(51) Int. Cl.
*A47L 23/22* (2006.01)

(52) U.S. Cl. ..... 15/161

(58) Field of Classification Search ..... 15/112, 15/161, 237
See application file for complete search history.

(56) References Cited

U.S. PATENT DOCUMENTS 613,133 A * 10/1898 Fobare ..... 15/237
6,557,203 B2 * 5/2003 Meshbesher ..... 15/104.92

FOREIGN PATENT DOCUMENTS

GB 2156203 * 10/1985
JP 9-252995 * 9/1997

* cited by examiner

*Primary Examiner*—Mark Spisich
(74) *Attorney, Agent, or Firm*—Robert J Doherty

(57) ABSTRACT

A boot scrubber having a housing including a pair of end members supporting a brush assembly therebetween and including at least one but preferably a pair of flaps hinged to the end members and operable to move from a storage position against the end members to a use position where the flaps extend like wings to either side of the scrubber.

5 Claims, 7 Drawing Sheets

BOOT SCRUBBER

TECHNICAL FIELD

This invention relates to boot scrubbers or scrapers, namely, implements having brushes mounted in a housing and placed near the entrance of an area such that the occupant or guest may move his or her shoes or boots against the brushes to dislodge sand, dirt, snow, mud and the like prior to entering such area. These devices are commonly referred to as boot scrubbers but, of course, have utility for many types of footwear and other objects such as bicycles, toys, tools and the like. While commercially available, the success of such devices has been limited despite their desirable feature of removing sand, grit and debris from boots prior to entering a house, etc. thus protecting popular flooring surfaces such as marble and pre-finished wood.

BACKGROUND OF THE INVENTION

Boot scrubbers of the type above referred to are well known and generally include fixed brushes mounted to a housing which, in turn, is fastened to the surface on which such is supported generally semi-permanently as by screwing the housing to a wooden porch or deck floor surface to assure that the device remains stationary when the user positioned adjacent the device passes his/her boots one at a time into contact with the brushes. Although operable, such devices mar the supporting surface to which they are secured and/or present mounting difficulties when it is desired to secure the device to surfaces such as flagstone, concrete, sand or grass, etc.

Some designs to overcome the above-indicated problem has been proposed as by materially increasing the device's width such as by providing integral platforms on either side of the brush unit such that the operator can stand on one of these platforms thus utilizing his/her own body weight to stabilize the unit such as shown in U.S. Design Pat. Nos. D386,858 and D439,714. As may be apparent from viewing such patents, such approach greatly increased the length and bulk of the unit. Recognizing such, boot scrubber products have incorporated decorative designs on or in such platforms in an attempt to reduce the device's bulky appearance such as the star cutouts in U.S. Pat. No. D439,714. While this approach may be more visually appealing, it does not remedy the obvious inconveniences caused by the device's overall increased length.

Accordingly, an object of the present invention is to provide a boot scrubber, which is compact, simple to operate and does not materially increase the bulk of the device beyond that necessary for operational functionality of the scrubbing brushes.

A further object of the invention is to provide a boot scrubber which can be easily moved to varied locations and which requires no semi-permanent or permanent fastening to its supporting surface.

These and other objects of the invention are accomplished by a boot scrubbing device for removing dirt and sand from boots one boot at a time of a person wearing such footwear while such person stands adjacent said device, said device including a housing including a pair of upright longitudinally-spaced members having generally planar outer surfaces and including bottom edge positions thereof, said housing further including a base member having laterally-spaced lower portions, said lower portions of said base member and said bottom edge portions of said upright members cooperatively forming a means for contacting an essentially flat supporting surface so as to position said device on said supporting surface, said base member and said upright members further cooperatively supporting a fixed brush assembly therebetween, and at least one of said upright members including a foot engageable housing positioning and stabilizing flap hingedly connected thereto, said flap being substantially planar and having an inner surface and an outer surface, said inner surface of said flap adapted for upright positioning against the outer surface of said at least one upright member when the flap is in a storage position and movable from said storage position to a position where said flap extends longitudinally from the bottom edge portion of said at least one upright member in a housing stabilizing position where the outer surface thereof rests on said supporting surface and the inner surface thereof faces upward for contact by the other boot of the person wearing such boot whereby the person's body weight stabilizes the position of the device while the one boot is being scrubbed.

Other objects, features and advantages of the invention shall become apparent as the description thereof proceeds when considered in connection with the accompanying illustrative drawings.

DESCRIPTION OF THE DRAWINGS

In the drawings that illustrate the best mode presently contemplated for carrying out the present invention.

DESCRIPTION OF THE PREFERRED EMBODIMENT

Figure 1:
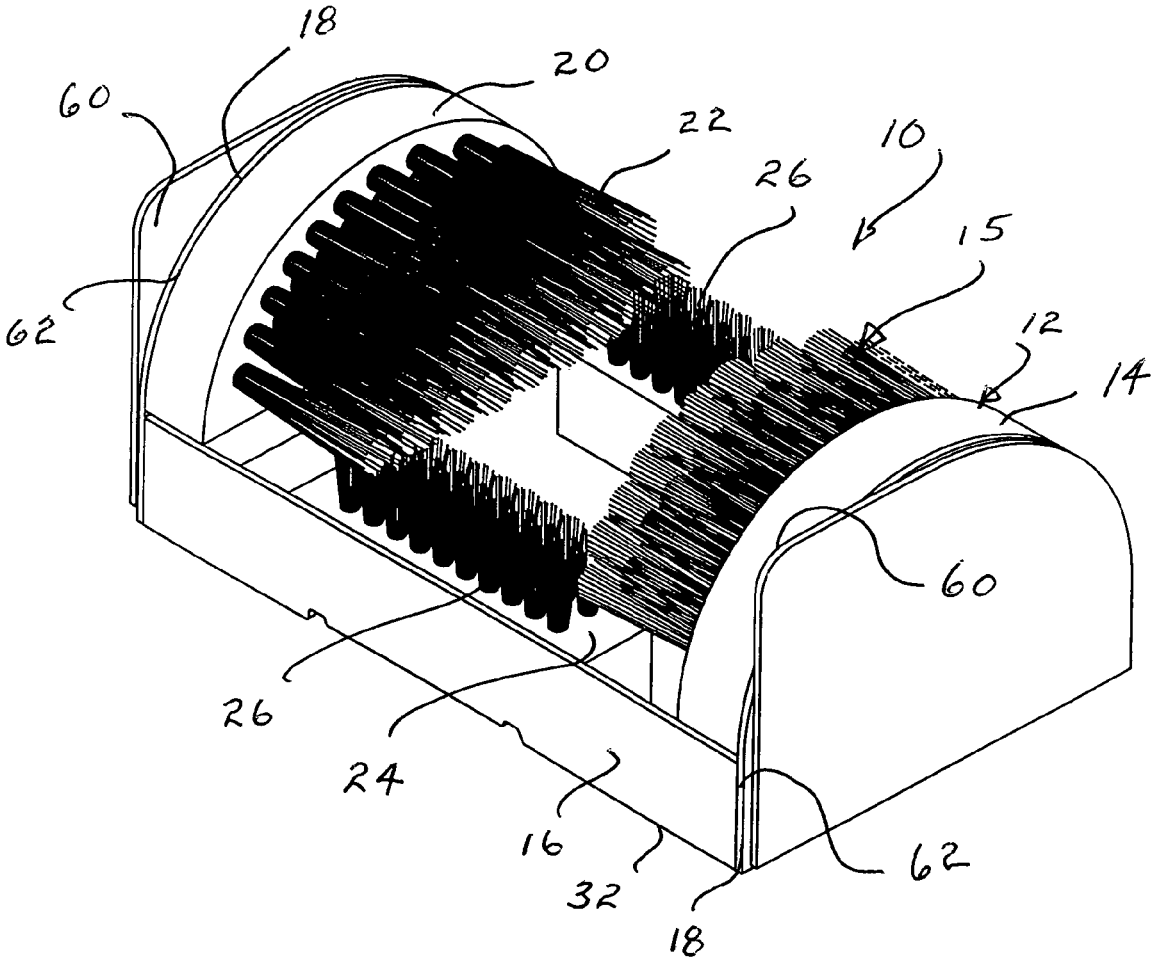
FIG. 1 is a front perspective view of a boot scrubber embodying the preferred form of the present invention.

Turning now to the drawings, a boot scrubber device 10 is shown having a housing 12 that, in turn, includes a pair of longitudinally spaced upright end members 14 and a pair of laterally spaced base members 16 connected thereto to compositely form such housing. The end members include an outer plate 18 having an outer surface 17 and an inner surface 19 to which a primary or side brush block 20 is attached. The primary brush block includes a plurality of inwardly extending bristles 22. The bristles 22 of each of the blocks 20 terminate short of each other approximately the width of a boot such that the user of the device can move his/her boot back and forth such that the boot sides are contacted by the bristles and debris such as dirt, sand, snow etc. is removed therefrom.

The housing further includes a pair of secondary or bottom brush blocks 24 attached to the base members. The bottom brush blocks 24 include sets of upwardly extending bristles 26. Generally, the base members and the upright members are formed of thin metal plate material and the blocks 20, 24 constructed of wood or plastic and the bristles held therein by friction within openings as with wood construction and by molding in situ as with plastic construction. The blocks are connected to their respective members by conventional means such as screws 28.

It may thus be apparent the blocks and their bristles form a brush assembly 15 fixedly positioned within the housing for brushing operation as intended. In order to position the device 10 upon an underlying supporting surface 30 on which the device 10 is adapted to rest as by contact therewith by the lower edge portions 32, 34 of the base and upright members respectively, at least one and preferably a pair of foot flaps 40 are attached to the lower edge portion 34 of each upright member. Each flap is generally planar and preferably formed of a magnetic material such as sheet steel that is also the preferred material for the upright members as well. The upright members may assume any desired cross-sectional shape such as the inverted U-shaped configuration depicted.

Figure 7:
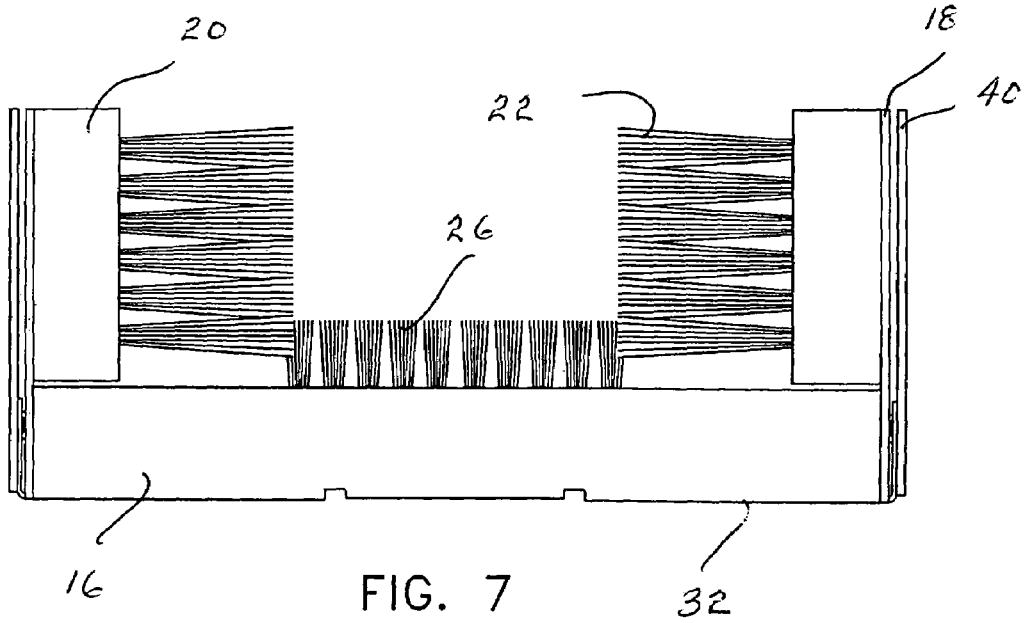
FIG. 7 is a front elevational view of FIG. 1.
Figure 8:
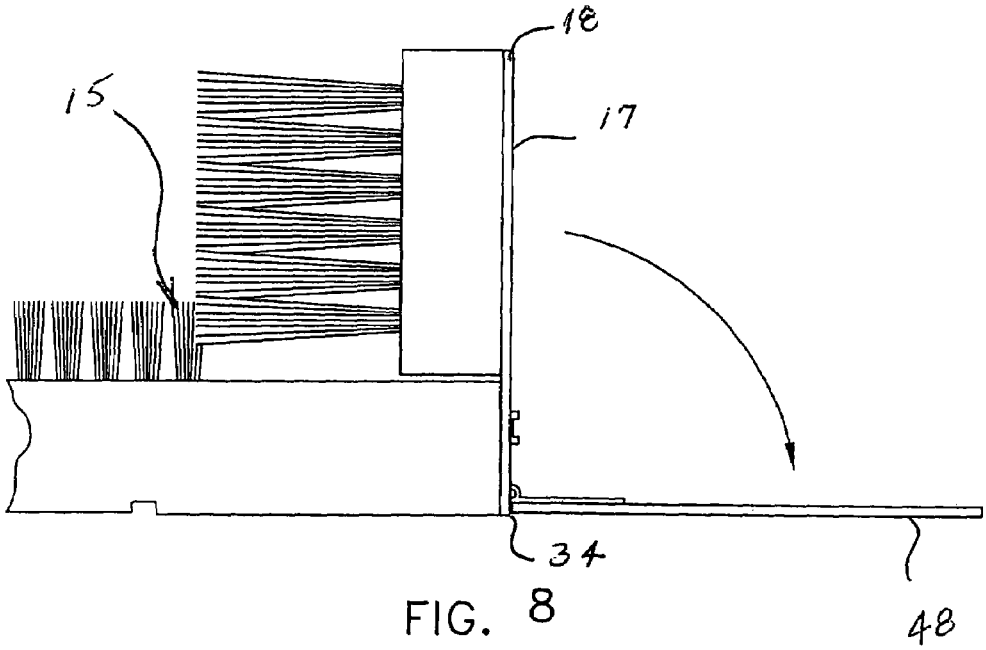
FIG. 8 is a front elevational view of FIG. 1 similar to FIG. 7 but with the right hand foot flap downwardly pivoted to its use position.

The foot flap 40 generally assumes the same planar configuration as the upright member associated therewith such that when the inner surface 42 of the flap is positioned against the outer surface 17 of the plate 18 of each of the upright members 14, the foot flap will blend in with the housing and appear and, in fact, contribute to a longitudinally compact device. Each flap is hingedly connected to its associated plate 18 via a hinge 44 positioned at the lower edge of the plate 18 and interconnected to both such plate and the foot flap. The outer surface 46 of the flap is preferably provided with an adhesively attached thin layer 48 of high friction material such as rubber and the like to entirely cover the outer surface 46 or at least cover a portion of such outer surface 46. When the foot flap 40 is downwardly moved from its storage position as shown in FIGS. 1 and 7 to its use position shown in FIGS. 2-4, 8-10, the high friction material will contact the supporting surface to provide better skid resistance when the user's foot is placed on the inner surface 42 to position the device on the supporting surface while moving the other foot back and forth through the brush assembly.

Figure 9:
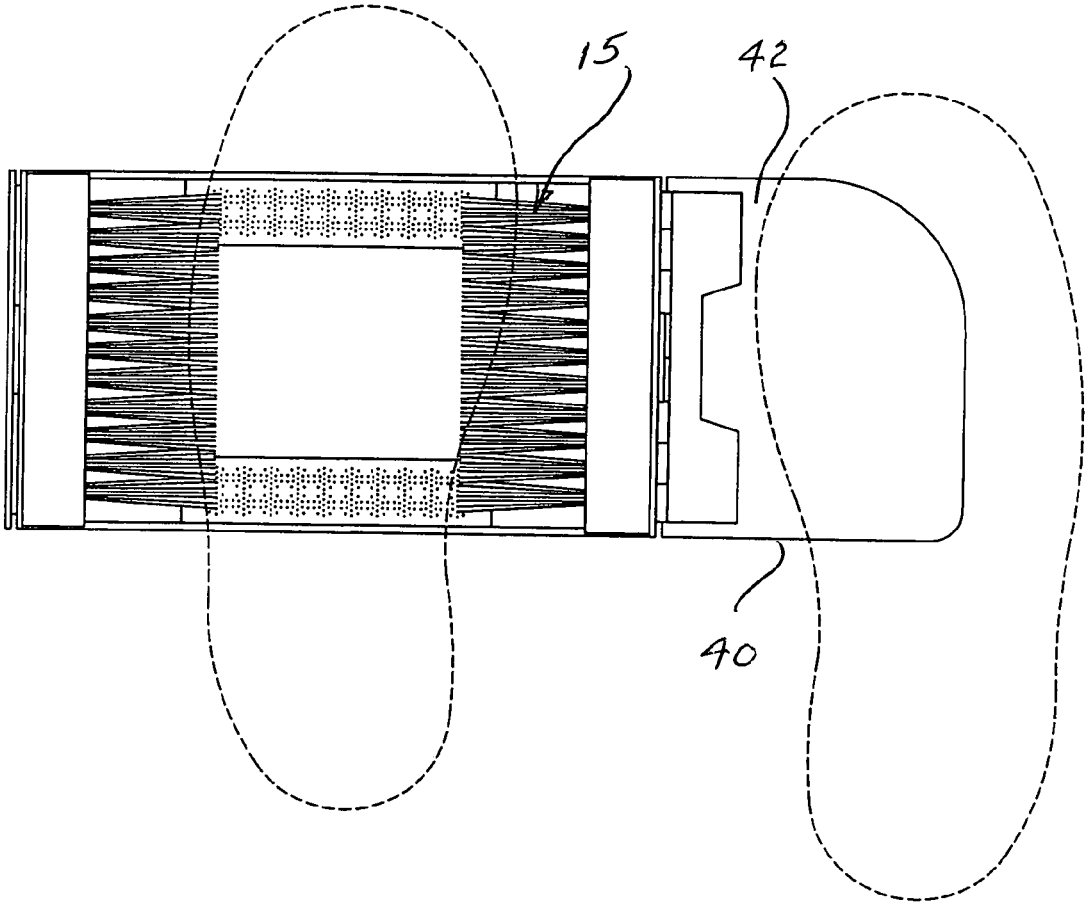
FIG. 9 is a top plan view of FIG. 8 showing the manner in which a user of the device may rest his/her right foot on the flap to stabilize the position of the device while moving his/her left foot across and back and forth over and through the brush assembly so as to remove sand, grit and the like from the left shoe or boot.
Figure 10:
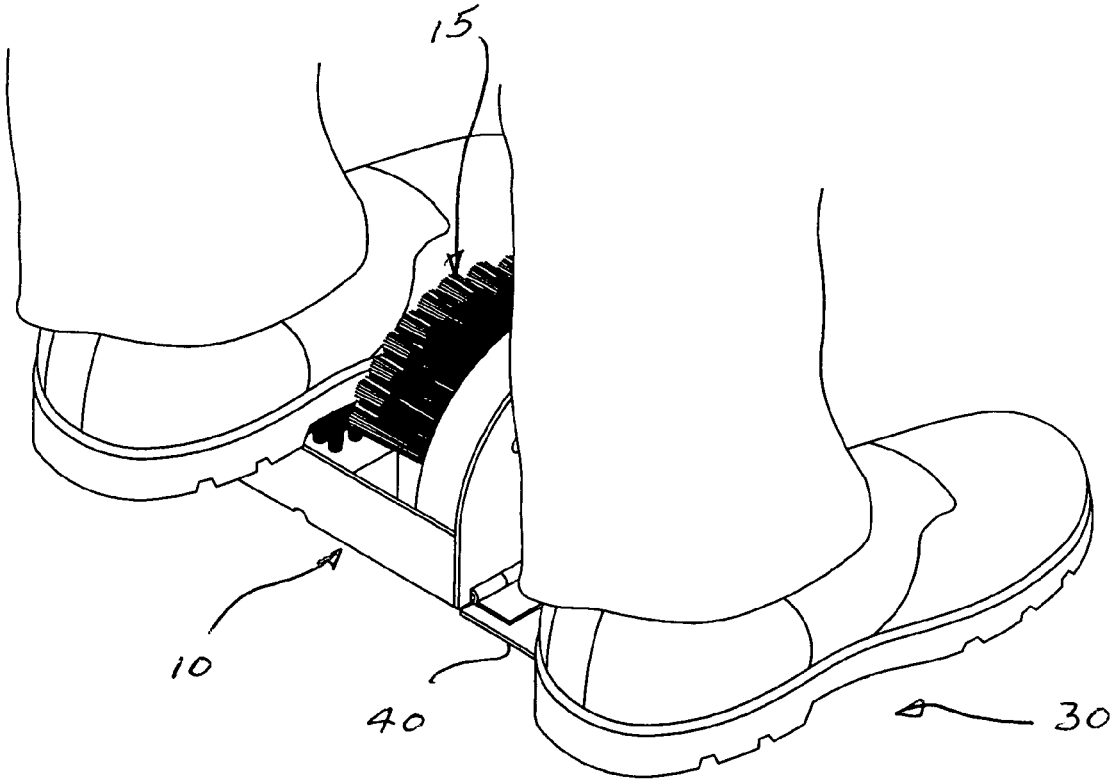
FIG. 10 is a front perspective view illustrating the same use mode depicted in FIG. 9.

The above procedure is clearly depicted in FIGS. 9 and 10 with the user holding the device 10 in position by exerting his or her body weight on the flap 40 through the right hand shoe while cleaning the left hand shoe. Obviously, the user in cleaning the right shoe would lower the left hand flap and place the left foot thereon while brushing the dirt, sand, etc. from the right shoe. In those cases where only one foot flap is provided, the device 10 can be lifted and rotated 180 degrees into position to clean the other boot or alternatively the user can simply approach the device from the opposite lateral side.

Figure 2:
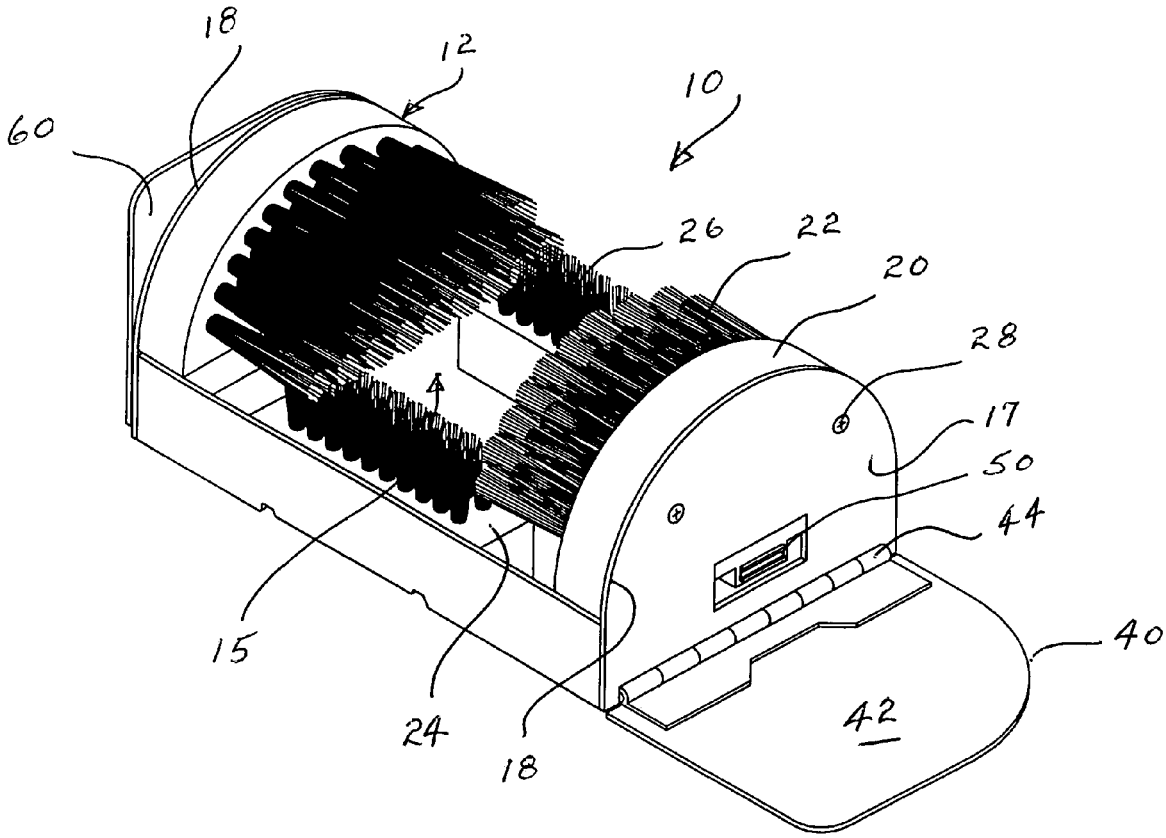
FIG. 2 is a front perspective view similar to FIG. 1 but showing one of the pair of foot flaps deployed in the boot scrubber's extended use position.
Figure 3:
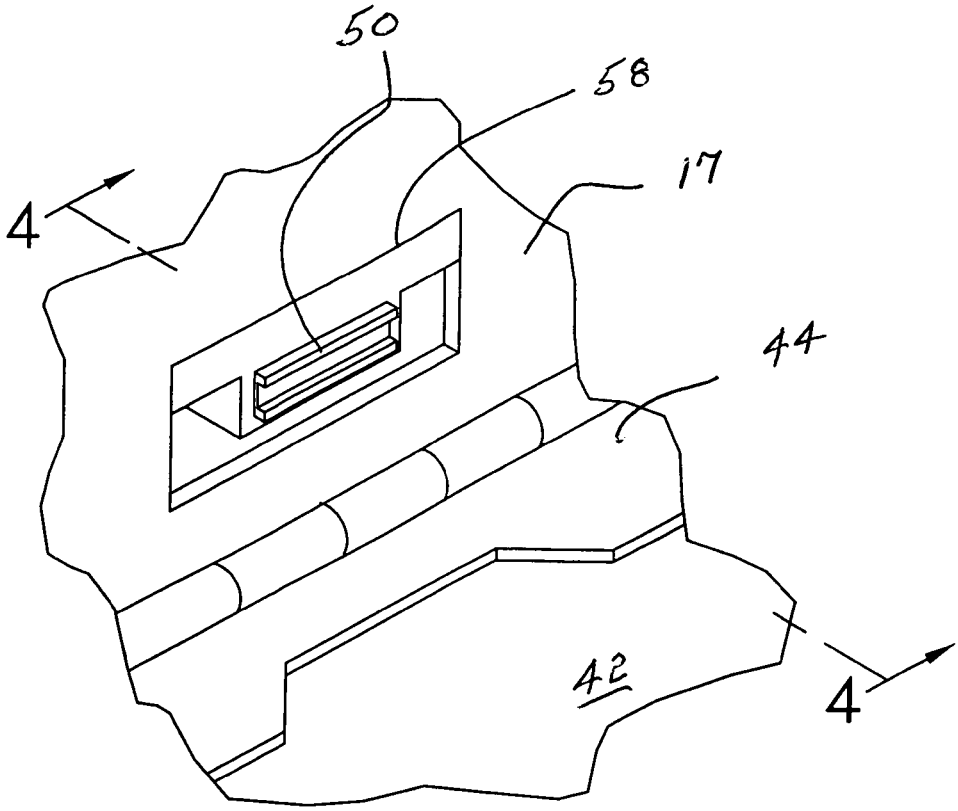
FIG. 3 is an enlarged partial perspective view of a portion of FIG. 2.
Figure 4:
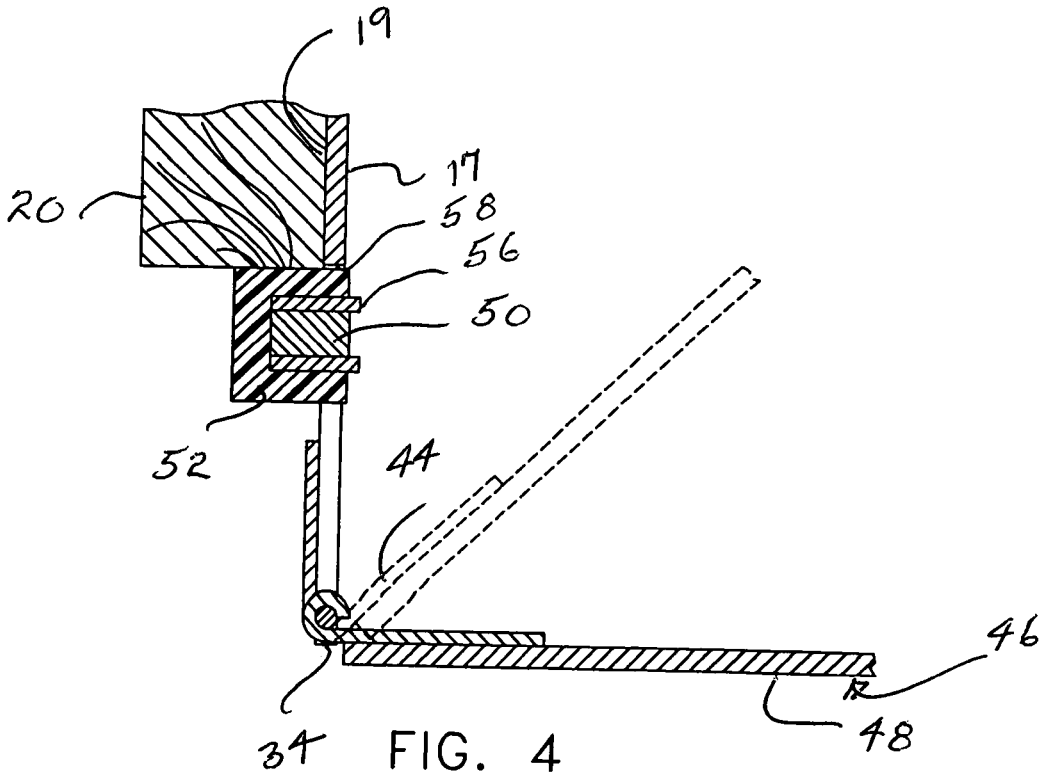
FIG. 4 is a sectional view along line 4-4 of FIG. 3.
Figure 5:
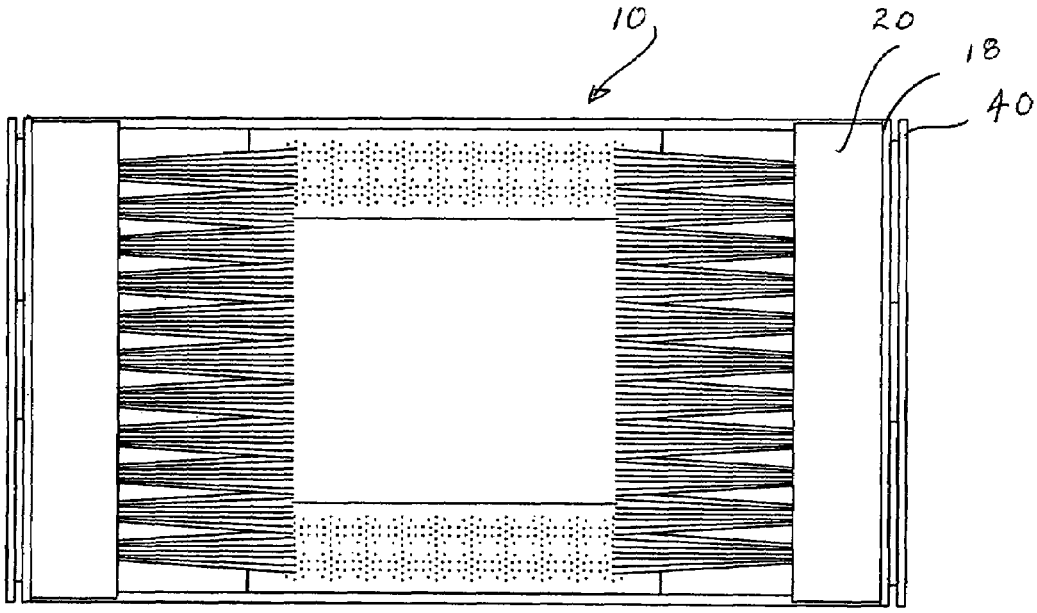
FIG. 5 is a top plan view of FIG. 1.
Figure 6:
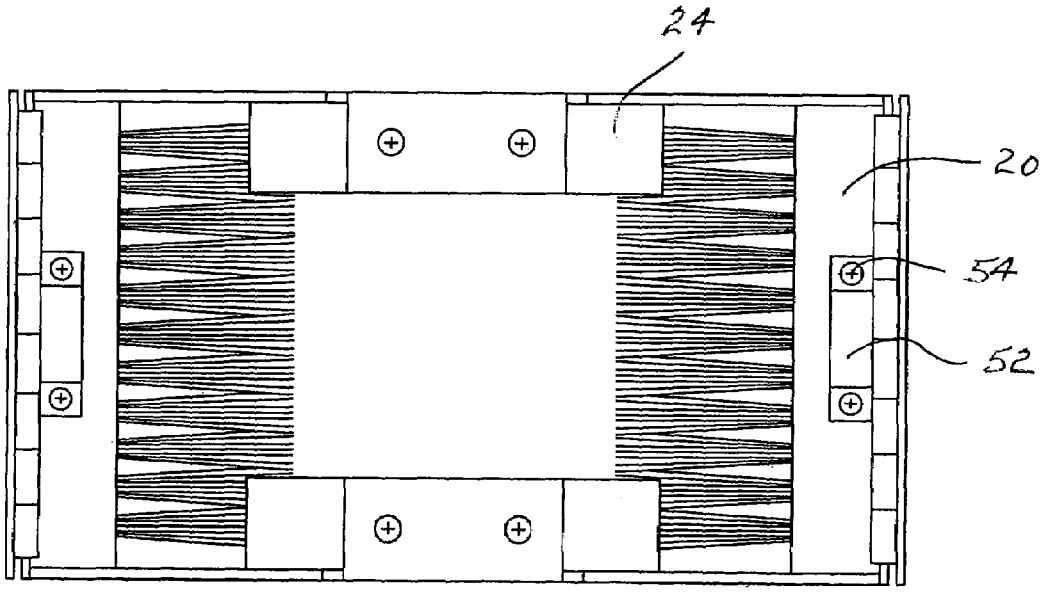
FIG. 6 is a bottom plan view of FIG. 1.

Turning now to FIGS. 2-4, a preferred means for holding or maintaining the foot flap in its upright non-use or storage position is shown in the form of a magnet 50 held by a block 52 in turn connected to a side block 20 as by screws 54 (see FIG. 6). The face 56 of the magnet is positioned through an opening or cut-out 58 through the plate 18 such that the magnet attracts the foot flap and holds the foot flap in its storage position.

Referring now to FIGS. 1 and 2 in particular, each of the foot flaps 40 includes a tab 60 generally integral therewith but which projects beyond the front edge 62 of the upright member 18 such that the tab 60 extends past the forward extent of the upright member and thus the user can easily and without bending or stooping down simply place the toe of the shoe intended for stabilizing the device adjacent the flap tab 60 and move the flap to the left or right and thus push or place the foot flap in the extended use position. The force applied by the user will overcome the magnetic attraction between the foot flap and plate.

While there is shown and described herein certain specific structure embodying this invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A boot scrubbing device for removing dirt and sand from boots one boot at a time of a person wearing such footwear while such person stands adjacent said device, said device including a housing including a pair of upright longitudinally-spaced members having generally planar outer surfaces and including bottom edge positions thereof, said housing further including a base member having laterally-spaced lower portions, said lower portions of said base member and said bottom edge portions of said upright members cooperatively forming a means for contacting an essentially flat supporting surface so as to position said device on said supporting surface, said base member and said upright members further cooperatively supporting a fixed brush assembly therebetween, and at least one of said upright members including a foot engageable housing positioning and stabilizing flap hingedly connected thereto, said flap being substantially planar and having an inner surface and an outer surface, said inner surface of said flap adapted for upright positioning against the outer surface of said at least one upright member when the flap is in a storage position and movable from said storage position to a position where said flap extends longitudinally from the bottom edge portion of said at least one upright member in a housing stabilizing position where the outer surface thereof rests on said supporting surface and the inner surface thereof faces upward for contact by the other boot of the person wearing such boot whereby the person's body weight stabilizes the position of the device while the one boot is being scrubbed.

2. The device of claim 1, wherein said flap is connected to the bottom edge portion of said one upright member.

3. The device of claim 1, wherein there is a pair of flaps each connected to an upright member and adapted to extend longitudinally from said housing in opposite directions from the longitudinal ends thereof in the operational positions of said flaps.

4. The device of claim 1, said flap formed of magnetically attractive metal and said one housing upright member including a magnet positioned therein and adapted to magnetically attract and hold said flap in its storage position.

5. The device of claim 1, said flap including a tab forwardly extending past the front edge of said at least one upright member whereby the user may laterally engage said tab to move said flap to the extended use position.

* * * * *